US006024026A

United States Patent [19]

Botts et al.

[11] Patent Number: 6,024,026

[45] Date of Patent: Feb. 15, 2000

[54] TRI-HEIGHT FOLDING STAGE

[75] Inventors: Rollin D. Botts, Bloomington; Gary W. Andert, Rosemount; Thomas J. Luedke, Apple Valley, all of Minn.

[73] Assignee: Sico Incorporated, Minneapolis, Minn.

[21] Appl. No.: 08/878,830

[22] Filed: Jun. 20, 1997

[51] Int. Cl.[7] ..... A47B 3/00

[52] U.S. Cl. ..... 108/170; 108/175; 248/188.5

[58] Field of Search ..... 108/166, 167, 108/170, 173, 175, 177, 115, 116, 129, 130, 147.19, 147.2, 147.21; 52/7, 6; 248/188.1, 188.5, 188.6, 188.8

[56] References Cited

U.S. PATENT DOCUMENTS

| | | | |
|---|---|---|---|
| Re. 24,454 | 4/1958 | Wilson . | |
| 89,306 | 4/1869 | Goodher . | |
| D. 304,499 | 11/1989 | Rogers et al. . | |
| D. 307,186 | 4/1990 | Rogers et al. . | |
| 770,152 | 9/1904 | Bechtel . | |
| 1,370,732 | 3/1921 | Corbett . | |
| 1,614,539 | 1/1927 | Ryan . | |
| 2,249,455 | 7/1941 | Caldwell . | |
| 2,258,133 | 10/1941 | Chuma . | |
| 2,278,817 | 4/1942 | Ziendler . | |
| 2,368,748 | 2/1945 | Doty . | |
| 2,503,997 | 4/1950 | Miller | 248/188.5 |
| 2,506,627 | 5/1950 | Spiegel et al. . | |
| 2,514,524 | 7/1950 | Steele . | |
| 2,621,095 | 12/1952 | Haumerson . | |
| 2,645,539 | 7/1953 | Thompson . | |
| 2,739,860 | 3/1956 | Wilson . | |
| 2,747,958 | 5/1956 | Wilson . | |
| 2,764,460 | 9/1956 | Nelson . | |
| 2,766,089 | 10/1956 | Nielsen . | |
| 2,771,937 | 11/1956 | Wilson . | |
| 2,782,075 | 2/1957 | Fagan . | |
| 2,831,741 | 4/1958 | Wilson . | |
| 2,873,157 | 2/1959 | Wilson . | |
| 2,887,348 | 5/1959 | Sadowsky . | |
| 2,969,245 | 1/1961 | Wilson . | |
| 2,977,169 | 3/1961 | Geller . | |
| 2,978,754 | 4/1961 | Wilson . | |
| 2,983,968 | 5/1961 | Wurn . | |
| 3,027,209 | 3/1962 | Nielsen . | |
| 3,028,197 | 4/1962 | Wilson . | |
| 3,034,843 | 5/1962 | Moon . | |
| 3,075,809 | 1/1963 | Wilson . | |
| 3,080,833 | 3/1963 | Risdall . | |
| 3,099,480 | 7/1963 | Wilson . | |
| 3,143,982 | 8/1964 | Blink et al. . | |
| 3,245,363 | 4/1966 | Amthor, Jr. et al. . | |
| 3,276,401 | 10/1966 | Wilson et al. . | |
| 3,337,262 | 8/1967 | Katzfey et al. . | |
| 3,351,029 | 11/1967 | Bue . | |
| 3,362,358 | 1/1968 | Farish, III | 108/170 |
| 3,437,058 | 4/1969 | Bue . | |
| 3,476,061 | 11/1969 | Takahashi . | |
| 3,557,720 | 1/1971 | Blink et al. . | |
| 3,701,450 | 10/1972 | Belzberg | 248/188.8 X |

(List continued on next page.)

FOREIGN PATENT DOCUMENTS

| | | | |
|---|---|---|---|
| 0 389 932 | 3/1990 | European Pat. Off. . | |
| 2 314 315 | 6/1975 | France . | |
| 2 418 319 | 2/1978 | France . | |
| 2 554 476 | 11/1983 | France . | |
| 2 587 784 | 9/1985 | France . | |
| 530320 | 7/1931 | Germany | 248/188.5 |
| 84 28 611 | 1/1985 | Germany . | |

*Primary Examiner*—Janet M. Wilkens
*Attorney, Agent, or Firm*—Merchant & Gould P.C.

[57] ABSTRACT

An elevationally adjustable folding stage folds between a use position wherein the panels are substantially planar, to a storage position wherein the panels face one another. Support legs are guided into a proper folding position by a guide plate having a surface angling relative to both the vertical and horizontal axis that provides for moving the leg into a fully extended position. A spacer assembly is utilized which includes a spreader member and a spacer member having tabs engaging the interior of an outer telescoping member. The spacer members provide better alignment and less wobble between the inner and outer members of the telescoping leg assembly.

21 Claims, 10 Drawing Sheets

U.S. PATENT DOCUMENTS

| | | |
|---|---|---|
| 3,799,073 | 3/1974 | Nielsen . |
| 3,861,325 | 1/1975 | Bue et al. . |
| 3,903,812 | 9/1975 | Cowley . |
| 3,999,491 | 12/1976 | Wilson . |
| 4,026,221 | 5/1977 | Wilson et al. . |
| 4,054,096 | 10/1977 | Wilson et al. . |
| 4,074,636 | 2/1978 | Wilson . |
| 4,104,835 | 8/1978 | Bardwick, III . |
| 4,133,271 | 1/1979 | Carlson . |
| 4,232,488 | 11/1980 | Hanley . |
| 4,327,650 | 5/1982 | Bue . |
| 4,570,751 | 2/1986 | Kleu . |
| 4,590,865 | 5/1986 | Rutsche et al. . |
| 4,615,279 | 10/1986 | de la Haye . |
| 4,627,364 | 12/1986 | Klein et al. . |
| 4,638,604 | 1/1987 | Rogers et al. . |
| 4,779,542 | 10/1988 | Staten et al. . |
| 4,779,878 | 10/1988 | Betts et al. . |
| 4,811,530 | 3/1989 | Eyerly . |
| 4,863,126 | 9/1989 | Rogers et al. . |
| 4,872,295 | 10/1989 | Fujita . |
| 4,917,217 | 4/1990 | Rogers et al. . |
| 4,934,113 | 6/1990 | Hall et al. . |
| 4,949,649 | 8/1990 | Terres et al. . |
| 4,979,340 | 12/1990 | Wilson et al. . |
| 5,050,353 | 9/1991 | Rogers et al. . |
| 5,317,842 | 6/1994 | Rogers et al. . |
| 5,323,563 | 6/1994 | Rogers et al. . |
| 5,367,963 | 11/1994 | Jaggi et al. . |
| 5,613,450 | 3/1997 | Wagner et al. ..... 108/175 |

TRI-HEIGHT FOLDING STAGE

BACKGROUND OF THE INVENTION

1. Field of the Invention

The present invention relates to Mobile Elevationally Adjustable Folding Stages that fold between a storage position and a use position.

2. Description of the Prior Art

Folding stages are used for a variety of purposes to provide a temporary raised platform for use in hotels, arenas, convention centers and other institutions or multiple use facilities that require the capability of setting up temporary stages. The stages are made up of individual stage structures positioned adjacent to each other to form an extended stage surface. When not in use, the individual stage structures may be folded to compact dimensions and stored.

Stages that are used for forming an elevated platform at lower heights, typically ranging between stages having a minimum height of 16 inches up to stages having a typical maximum height of 48 inches, generally fold at their center with the stage decks folding to a substantially vertical storage position whereat the upper surfaces face one another. A folding linkage facilitates folding between the use position and the storage position. Support legs fold inward to lie substantially flush against the underside of the stage decks. When folded, the stages are supported on rollers or casters for transportation between locations.

An example of such a tri-height stage is shown in U.S. Pat. No. 5,613,450 assigned to Sico, Inc., the Assignee of the present invention. Although this stage provides many advantages over the prior art and is very useful, still further improvements are possible. The stage shown in the '450 patent provides advantages for guiding the legs into position during unfolding, but provides only a frame member angling inward. Moreover, the engagement edge extends only in a horizontal plane rather than angling vertically as well.

In addition, a typical problem with tri-height stages is the small amount of overlap between the telescoping leg members when extended. The minimal amount of overlap in the extended position may affect the stability of the telescoping legs and may result in a more wobbly leg and more play between the inner and outer portions of the telescoping leg. Additional overlap provides increased stability, but may increase the minimum height of the stage or may limit the vertical adjustment range.

It can be seen then that a new and improved tri-height folding stage is needed. Such a stage should provide for guiding of an inner leg member with a guiding surface angling in both a vertical and horizontal plane. In addition, such a stage should provide for more stable telescoping of the leg without affecting the height or vertical adjustment. The present invention addresses these as well as other problems associated with folding stages.

SUMMARY OF THE INVENTION

The present invention is directed to a folding stage adjustable to several heights. The stage includes a pair of stage decks which fold from a planar position to a substantially vertical storage position wherein upper surfaces of the decks substantially oppose one another. The stage includes a linkage which folds the panels and outer support legs between the use and storage positions. Inner support legs fold independently proximate the folding axis of the stage. Outer support legs fold with the linkage between a retracted position against the bottom of the stage decks and an extended support position. Both the inner support legs and outer support legs telescope to raise and lower the stage surface.

It can be appreciated that as the inner support legs fold independently of the linkage, it is important that the inner support legs be fully extended in a vertical position extending at a right angle to the stage decks. The present invention includes a caster plate supporting the casters and having an angled edge extending inwardly. The angled edge includes a flange that extends downward and includes an outer and upward angling lower surface. The caster plates are arranged and configured so that if an inner support leg is not totally unfolded, the inner support leg engages the edge of the caster plate flange and is moved into a fully unfolded vertical position. It can be appreciated that the flange provides both an angled surface in the horizontal plane as well as an angled surface in the vertical plane.

To accommodate low stage heights and maximum elevational adjustment, the amount of overlap between telescoping support leg sections is minimized. The present invention utilizes a spacer system having a spreader member and a spacer member having flanges extending radially outward. The spacer system assembly attaches to an upper end of an inner telescoping leg member and inserts within the outer telescoping leg member. When the spreader member is tightened, it presses the flanges of the spacer member to extend outward and engage the inner surface of the outer telescoping leg member. In addition, the lower edge of the outer telescoping member is crimped inward to form a smaller rectangular opening. The corners where the lower crimped portions intersect form flanges extending diagonally outward. This intersection is welded to maintain the close tolerances between the inner support member and the rectangular opening of the outer telescoping member.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding structure throughout the several views.

DETAILED DESCRIPTION OF THE PREFERRED EMBODIMENT

Figure 1:
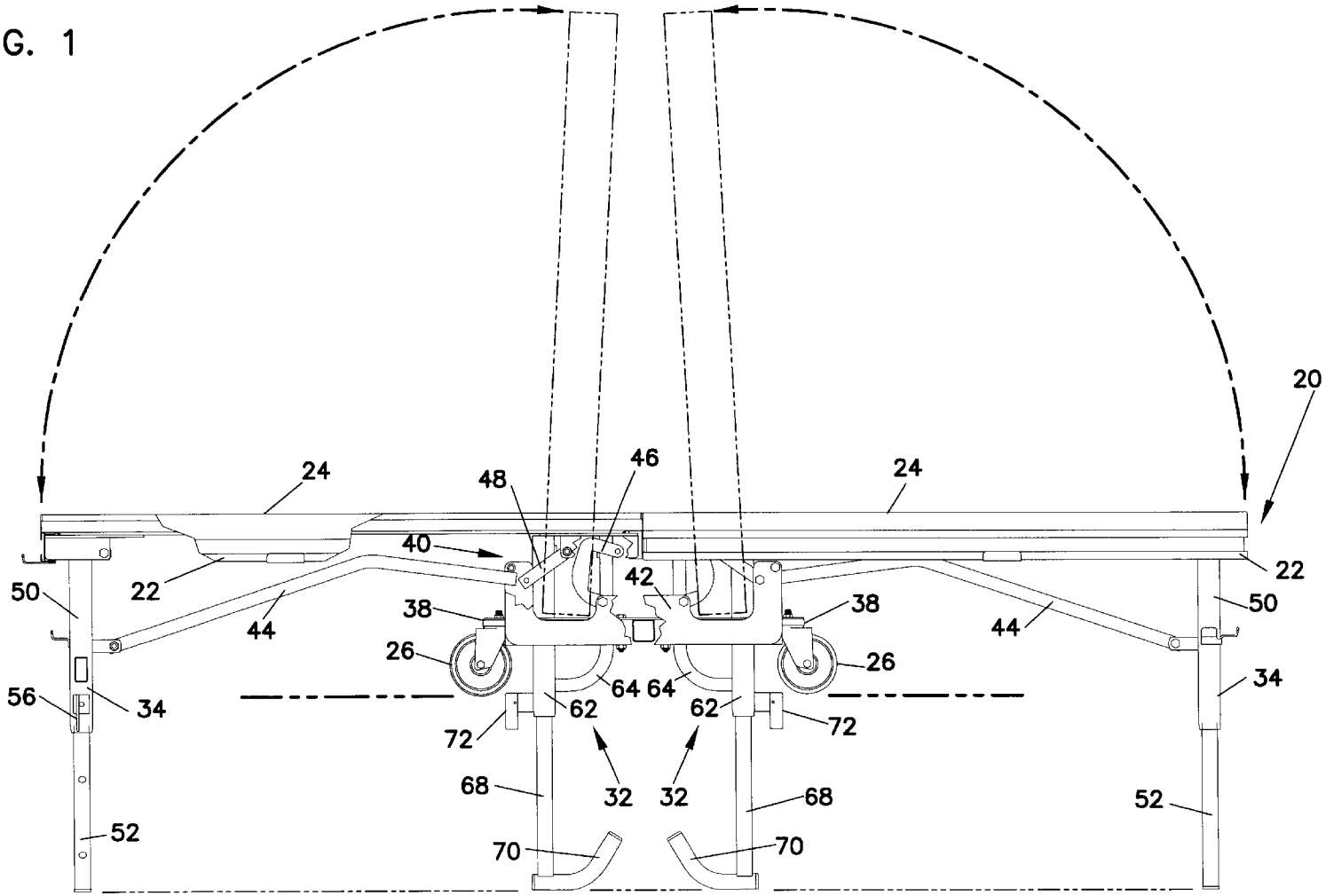
FIG. 1 shows a partially broken away side elevational view of a tri-height folding stage according to the principles of the present invention in an unfolded position and shown in phantom in a folded position.
Figure 2:
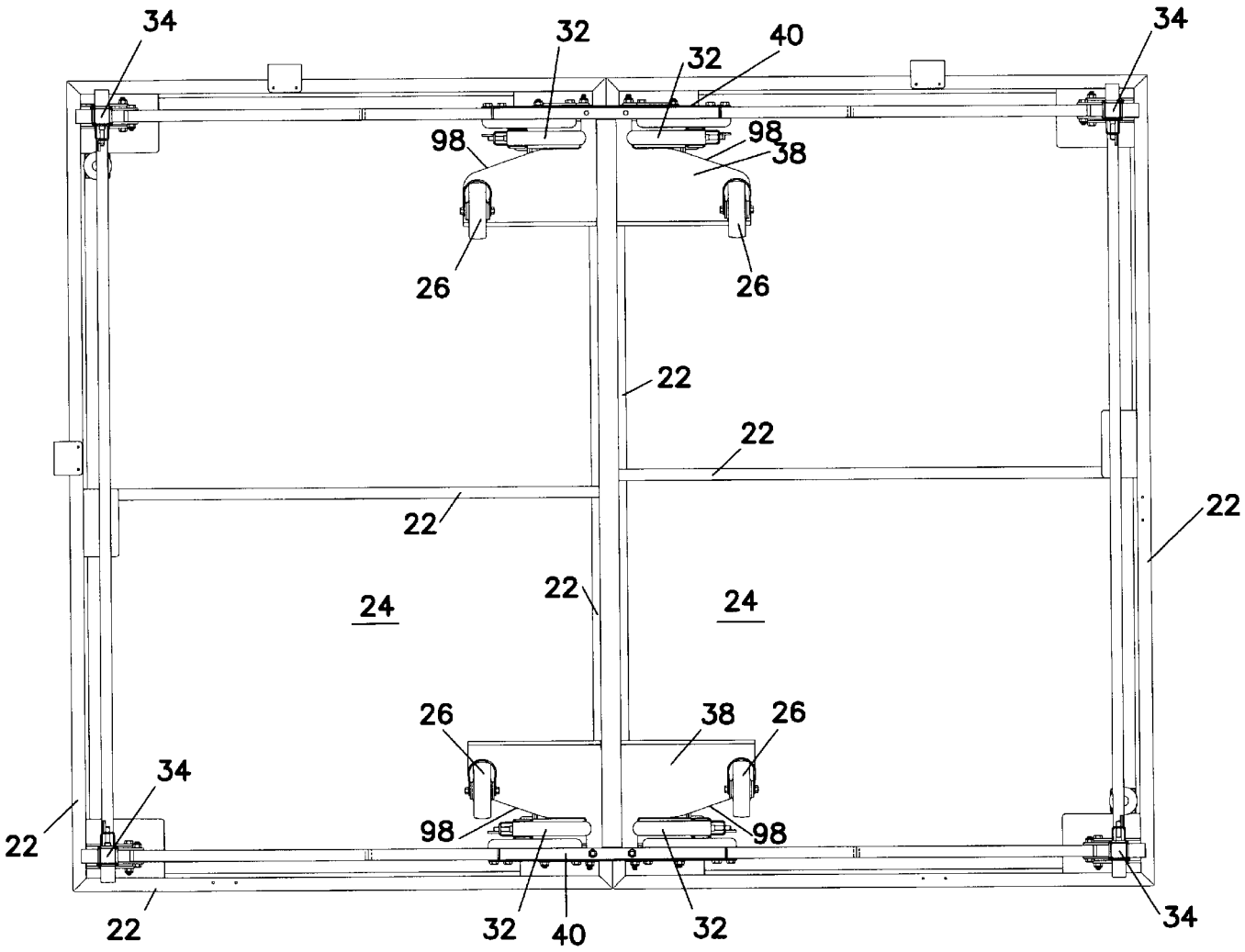
FIG. 2 shows a bottom plan view of the stage shown in FIG. 1 in an unfolded use position.
Figure 3:
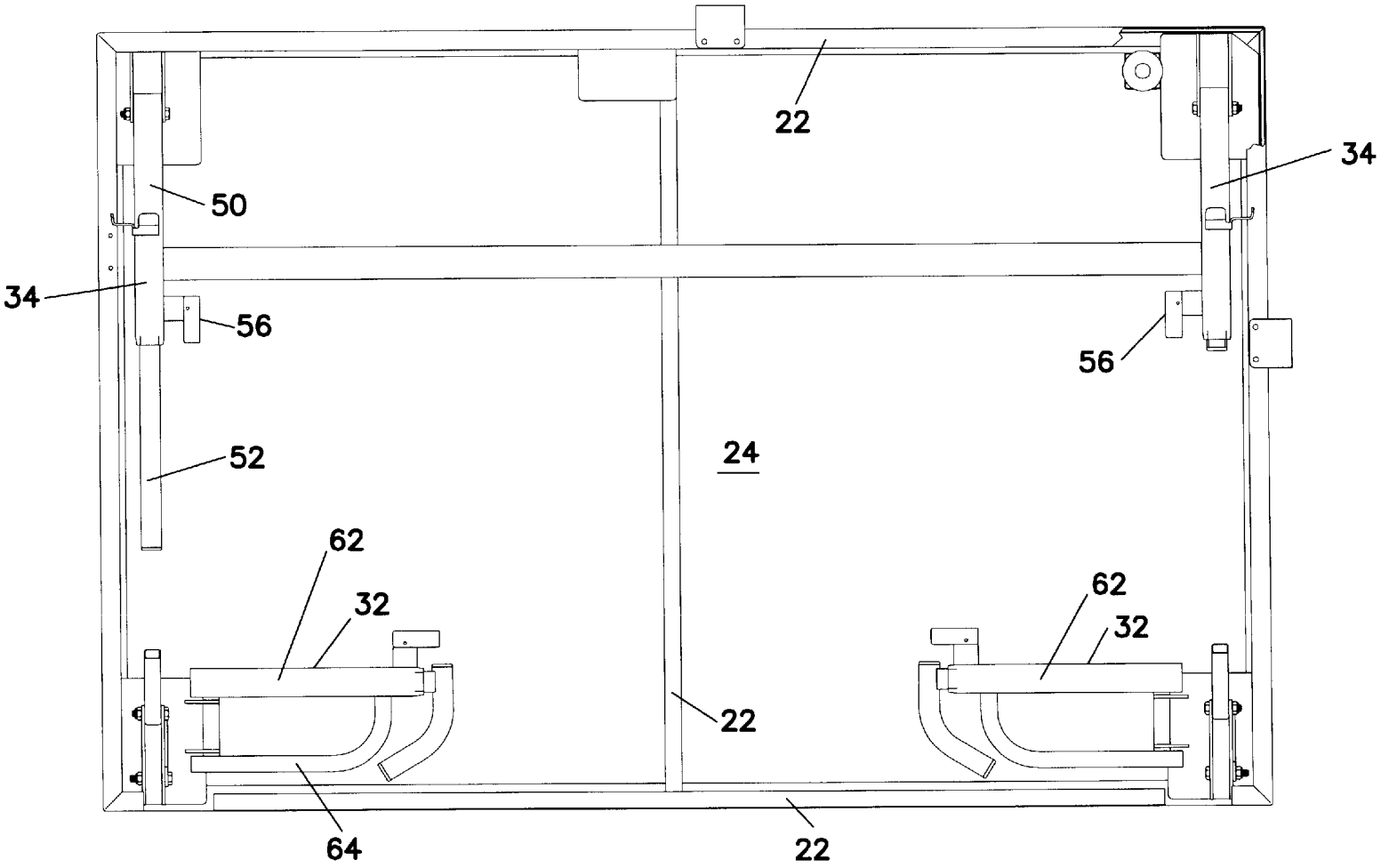
FIG. 3 shows a side elevational view of the bottom of a stage deck for the stage shown in FIG. 1 in a folded storage position.

Referring now to the drawings, and in particular to FIG. 1, there is shown a mobile folding stage, generally designated 20. The stage includes a folding frame 22 supporting a pair of stage decks 24. As shown in FIG. 1, in an unfolded position the stage decks 24 extend horizontally forming a horizontal planar stage surface. As shown in phantom, the stage decks 24 fold to a storage position wherein the stage decks are just past vertical with upper faces of the stage decks 24 opposing one another. The stage 20 is supported on inner support legs 32 and outer support legs 34 which project vertically at a support position, as shown in FIG. 1. When the stage 20 is folded, as shown in FIG. 2, the inner support legs 32 and the outer support legs 34 retract to a position lying substantially flat against the lower surface of the stage decks 24. The bottom of the stage decks 24 extend substantially vertically and face outward when in the folded storage position.

Figure 4:
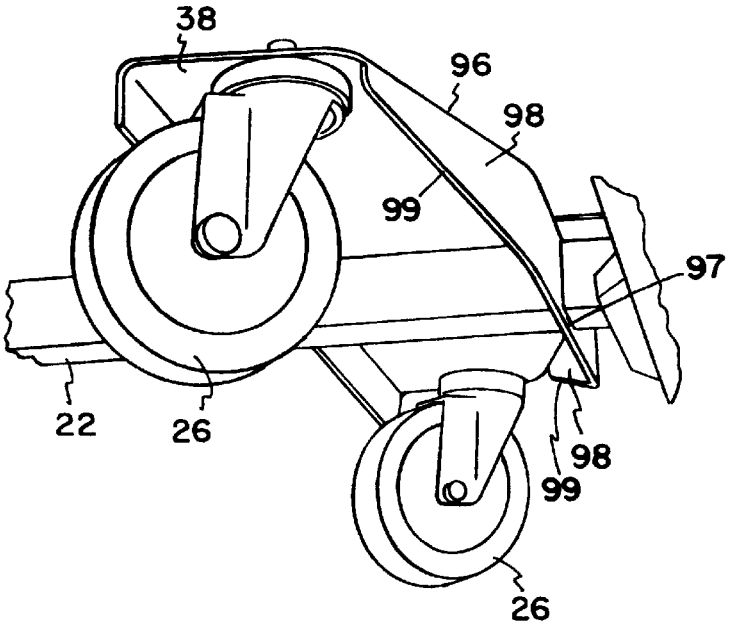
FIG. 4 shows a bottom perspective view of a caster plate and associated guide flange for the stage shown in FIG. 1.
Figure 6:
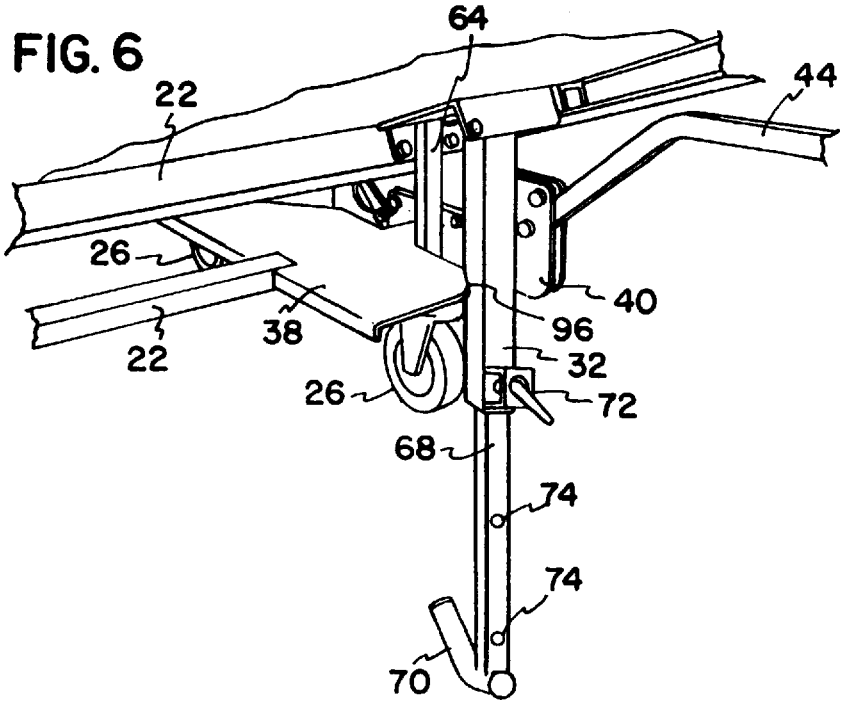
FIG. 6 shows a perspective view of the caster plate shown in FIG. 4 with the stage partially folded and the inner leg engaging the guide flange.
Figure 5:
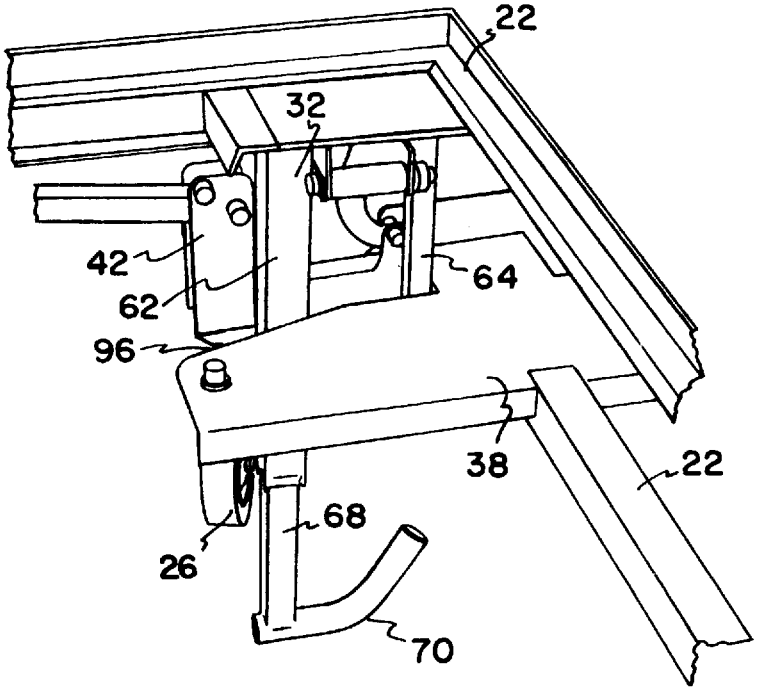
FIG. 5 shows a perspective view of the caster plate shown in FIG. 4 with an inner support leg unfolded and engaging the edge of the caster plate.

As shown in FIG. 1, the stage 20 is rolled on casters or rollers 26 which are mounted on caster plates 38 mounted at opposite ends along the folding axis and center line beneath the stage 20. As shown in FIG. 4, each caster plate 38 includes an angled end portion as also shown in FIGS. 5 and 6, with a flange 98 extending vertically downward from the edge 96.

Figure 7:
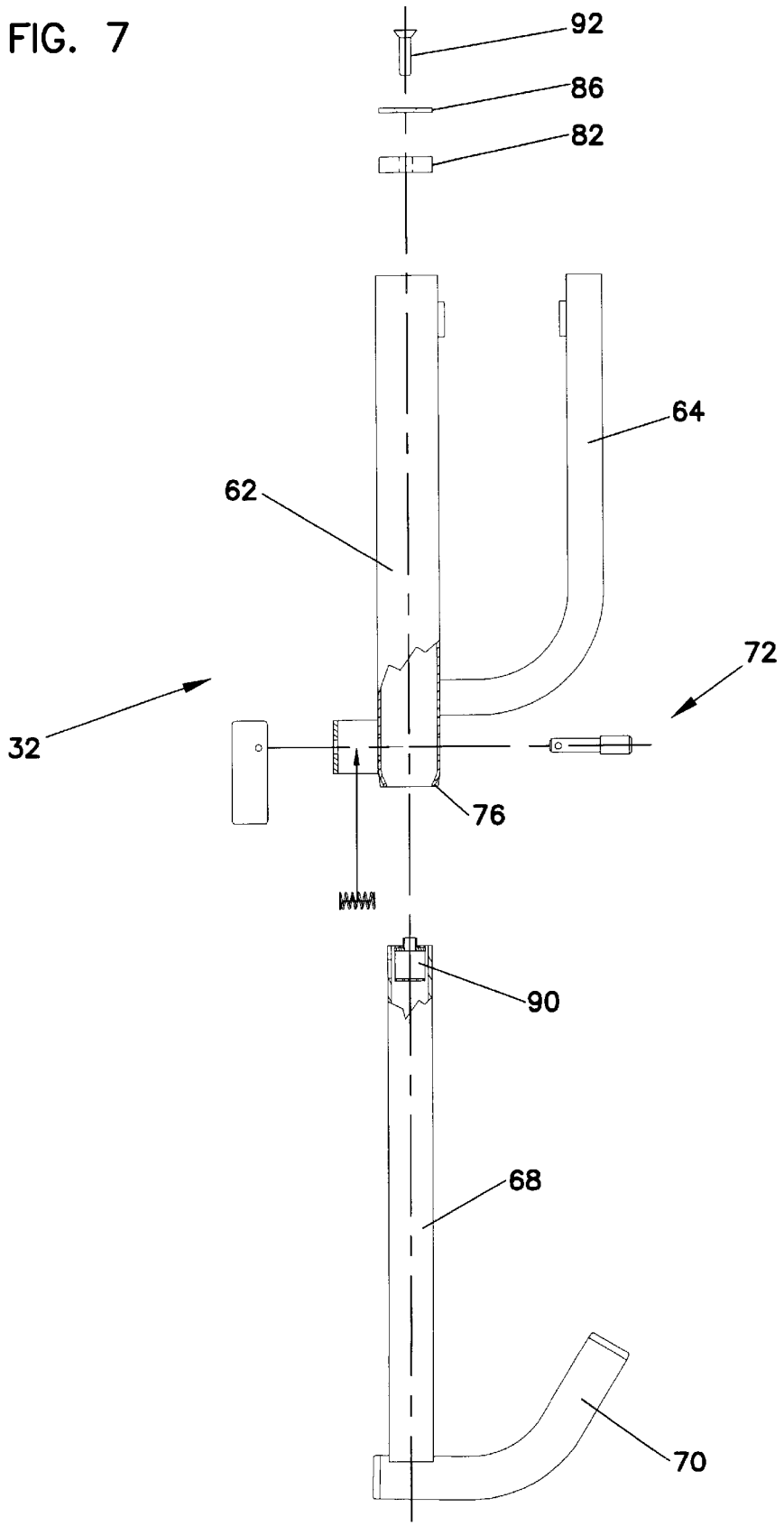
FIG. 7 shows an exploded side view of an inner support leg for the stage shown in FIG. 1.

Shown most clearly in FIG. 7, the inner legs 32 include an upper outer portion 62 with a guide bracket 64 attached thereto. The guide bracket 64 includes a rounded inner corner portion which engages the flange 98, as explained hereinafter to guide the inner support legs 32 into an aligned vertical position when unfolded. As also shown in FIG. 7, the inner support legs 32 include a lower telescoping portion 68 with a foot 70 extending inwardly toward the folding axis of the stage at a lower portion of each leg 32. The foot 70 includes a curved lower surface to support and slide the legs 32 into position when the stage is folded and unfolded. The inner support legs 32 also include a spring loaded pin assembly 72 which engages orifices 74 on the lower portion 68 to provide for incremental height adjustment.

In a similar manner, as shown in FIG. 1, the outer support legs 34 include an upper telescoping portion 50 and a lower inner telescoping portion 52. The outer support legs 34 also include a spring loaded pin assembly 56 engaging orifices in the lower telescoping portions 52 for incremental height adjustment.

The stage 20 includes a folding linkage 40 which includes a linkage plate 42 at each end along the center folding axis, that forms a pair of channels receiving the decks when the stage is in the folded storage position. The linkage includes a U-shaped channel link member 46, a short link member 48 and an extended link member 44 which connects to the outer legs. The operation of the linkage provides for smooth folding between the folded and unfolded positions, as explained in U.S. Pat. No. 5,613,450 to Wagner and incorporated herein by reference.

Referring to FIG. 2, in the folded position, the linkage 40 folds the outer legs 34 to a folded position flat against the under side of the decks 24. Similarly, the inner support legs 32 fold independently substantially flat against the under side of the stage decks 24. In this manner, the stage 20 has a smaller profile and takes up substantially little floor space during storage. It can be appreciated that the low height and the desired elevational adjustment of the present invention provides a stable, non-wobbling, telescoping leg configuration. As shown in FIGS. 9–12, the upper portion of the lower leg includes a spacer assembly 80 which allows for the leg portions 62 and 68 to telescope relative to one another while providing very little play between the members. Although reference is being made to the upper portion 62 and lower portion 68 of the lower support legs 32, it can be appreciated that the outer support legs 34 with upper portions 50 and lower inner telescoping members 52 also utilize spacer assemblies.

Figure 8:
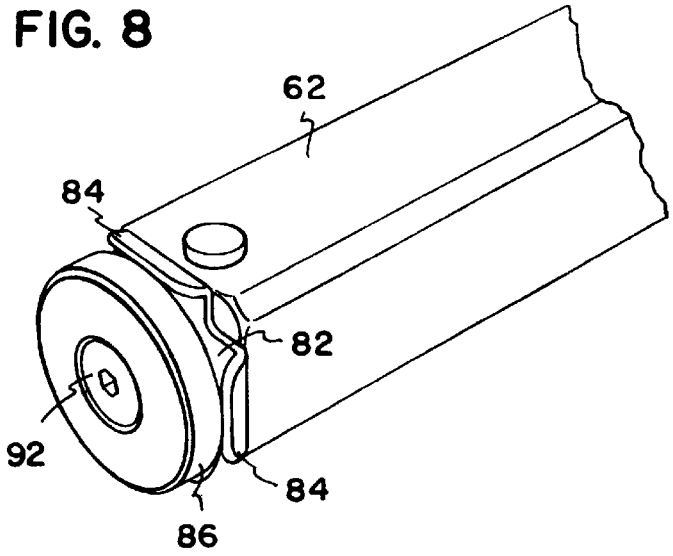
FIG. 8 shows an end perspective view of an inner telescoping member for the leg shown in FIG. 7.
Figure 13:
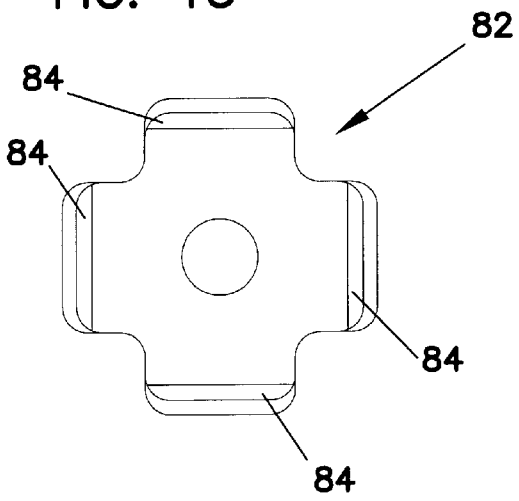
FIG. 13 shows a top plan view of a flanged spacer member for the spacer assembly.
Figure 14:
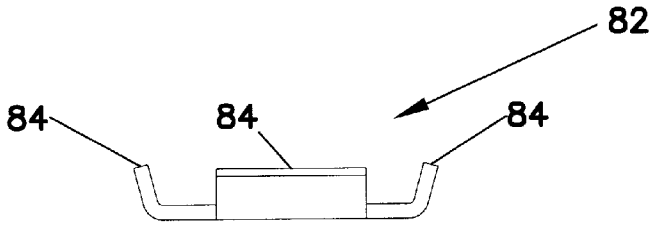
FIG. 14 shows a side elevational view of the flanged spacer member shown in FIG. 13.

A first embodiment of a spacer assembly, designated 80, includes a spreader member 86 shown as a washer or disk, having a lower tapered edge 88. A clover leaf type spacer member 82 includes outer tab or flange portions 84 which extend radially outward and are angled slightly upward. The spacer member 82 shown in FIGS. 13 and 14, mounts to a mounting section 90 at the upper portion of the lower leg 68. A connector member 92 such as a screw or a bolt threadably connects to the mounting section 90 and retains the spreader member 86 and the spacer member 82 against the mounting section 90, as also shown in FIG. 8.

Figure 9:
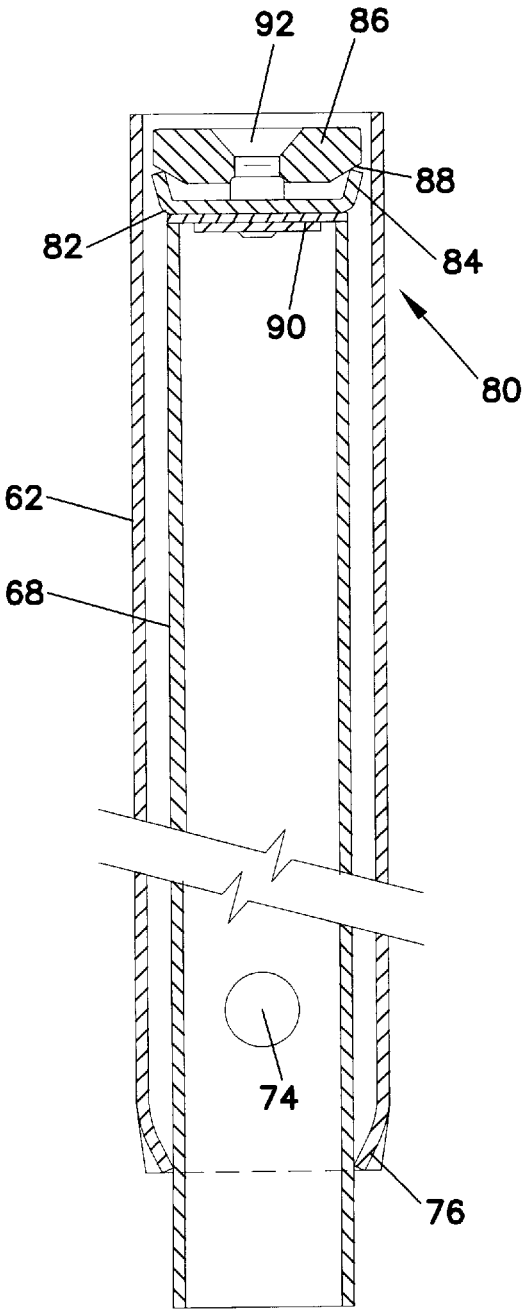
FIG. 9 shows a side sectional view of an upper portion of the inner support leg shown in FIG. 1.
Figure 10:
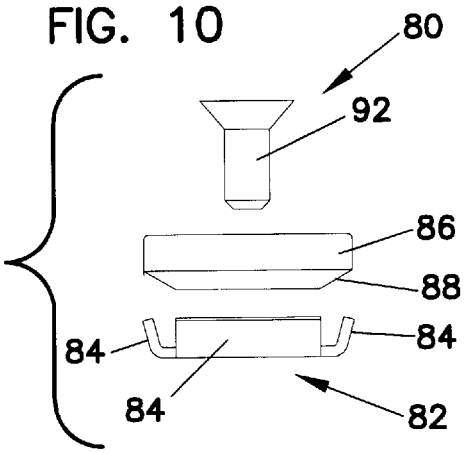
FIG. 10 shows a side elevational view of a first embodiment of an upper spacer assembly at the upper end of the inner telescoping member shown in FIG. 8.
Figure 11:
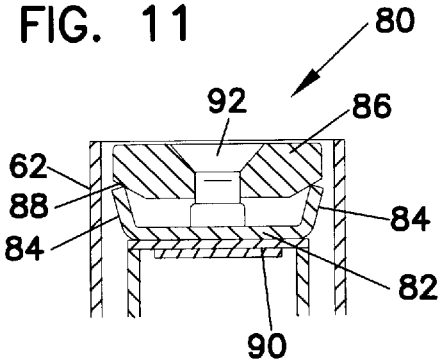
FIG. 11 shows a side sectional view of the upper portion of the inner support leg shown in FIG. 7 with the spacer assembly in a non-engaging position.
Figure 12:
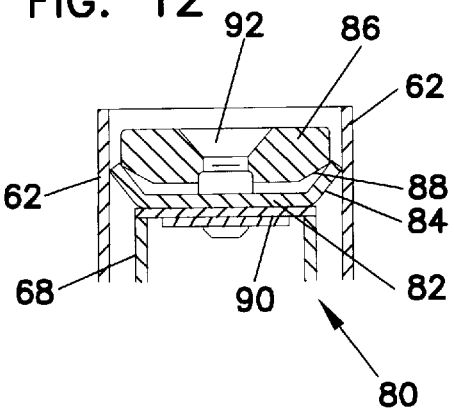
FIG. 12 shows a side sectional view of the upper portion of the inner support leg shown in FIG. 7 with the spacer assembly engaging the outer telescoping member.

It can be appreciated that to provide a snug fit, the tabs 84 of the spacer member 82 engage the inner portions of the sides of the upper leg member 62. During assembly, as shown in FIGS. 9 and 11, the tapered lower edge 88 of the spreader member 86 engages the upper portion of the tabs 84 of the spacer member 82. As the connector member is tightened, the tapering edges 88 force the tabs 84 outward to engage the inside of the outer leg 62, as shown in FIG. 12. It can be appreciated that the spreader member 86 and the spacer member 82 are aligned relative to one another with the connector member 92. It can also be appreciated that the spreader member 86 will seat substantially within the flanges 84 and force the tabs 84 into engagement with the inner wall of the outer leg member 62.

Figure 16:
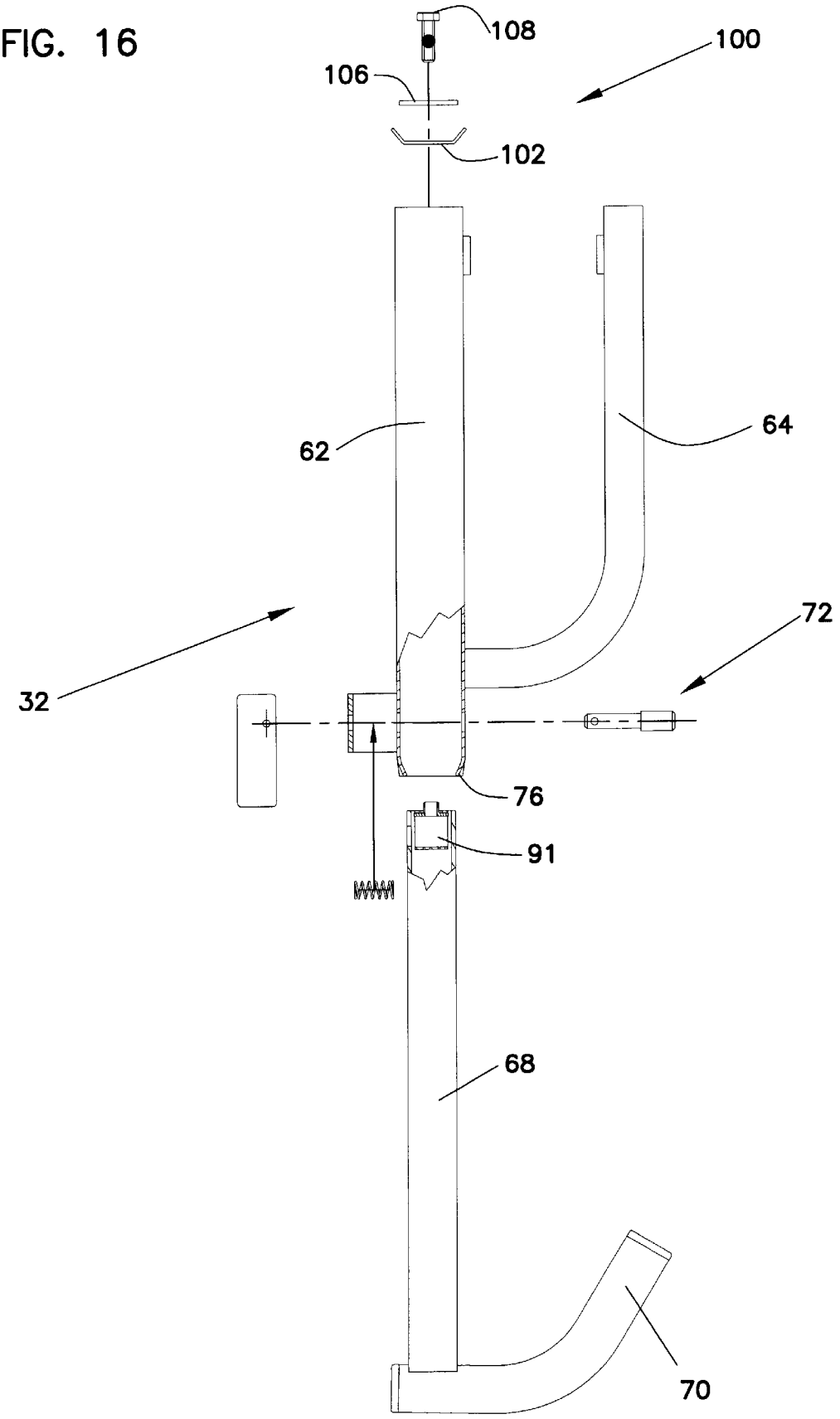
FIG. 16 shows an exploded side view of a second embodiment of a spacer assembly and an inner support leg for the stage shown in FIG. 1.
Figure 17:
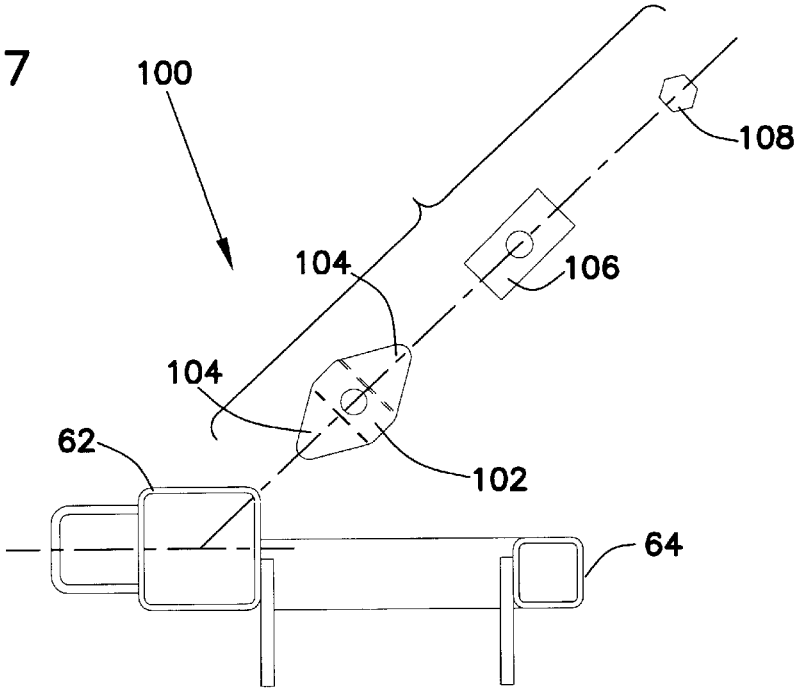
FIG. 17 shows an exploded top plan view of the inner support leg and spacer assembly shown in FIG. 16.
Figure 18:
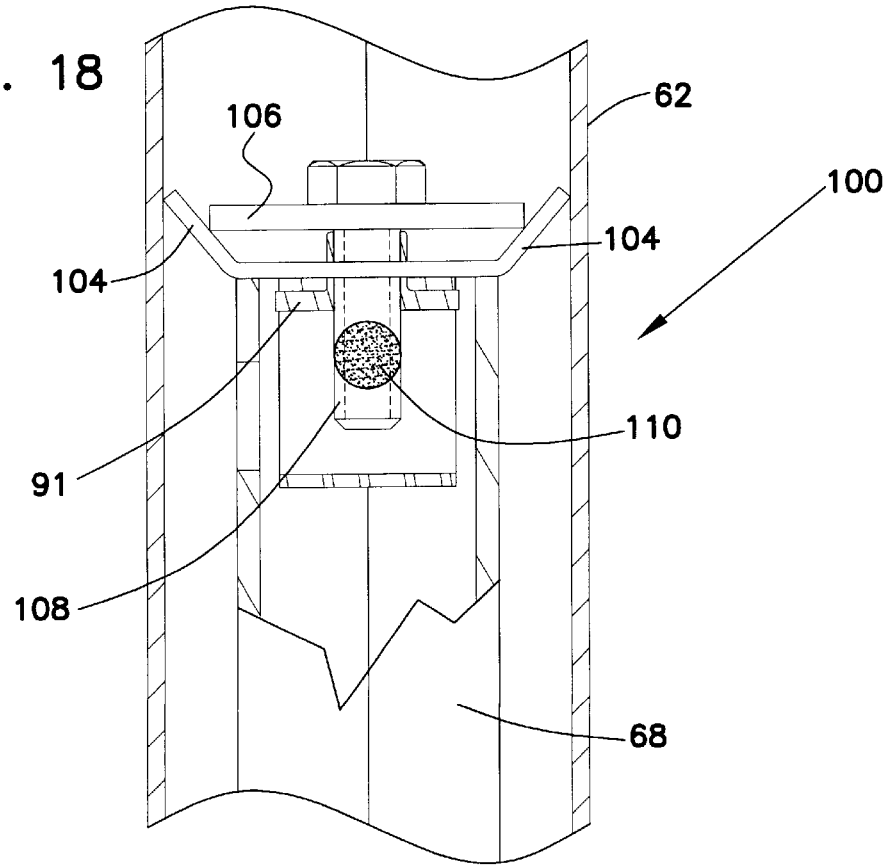
FIG. 18 shows side sectional view of the inner support leg and spacer assembly shown in FIG. 16.

Referring to FIGS. 16–18, there is shown a second embodiment of a spacer assembly, generally designated 100.

The spacer assembly 100 also provides for a better fit between the leg portions 62 and 68. The spacer assembly 100 includes a spacer member 102 having tapered tabs 104 extending outward. The tapered tabs 104 are angled obliquely to the plane of the spacer member 102 for engaging the interior of the upper leg member 62. The spacer member 102 includes an orifice extending therethrough for receiving a screw or other connector member 108. The screw member 108 inserts into a mounting section 90 at the upper end of the lower leg member 68. A spreader element 106 is substantially rectangular and includes an orifice formed therethrough for receiving the screw member 108. The spreader element 106 is placed to engage the angled tabs 104. The connector member 108 includes a resistance portion 110 which helps to lock the screw member 108 in a stationary position in the mounting section 90. The resistance portion 110 has a plastic plug inserting into a recess in the screw body, or other locking substance for engaging threads of the mounting section 90 and resisting rotation.

In operation, the spacer assembly 100 is placed on the mounting section 90. The screw assembly 108 is inserted through the orifices in the spacer member 102 and the spreader element 106. The spreader element 106 is oriented so that it is aligned lengthwise with the tabs 104 of the spacer member 102 and is engaging the inner angled surfaces of the tabs 104. It can be appreciated that as the screw 108 is tightened against the mounting section 90, the spreader element 106 is forced against the inner angled surfaces of the tabs 104, pushing the tabs 104 outward. When the tabs 104 are pushed outward sufficiently to engage the inner walls of the upper leg 62, the tabs 104 provide spacing and alignment between the inner leg 68 and the upper leg 62. The tabs 104 facilitate easy telescoping between the inner leg 62 and outer leg 68 without providing too much resistance so that the telescoping members cannot slide. It can be appreciated that the tabs 104 taper to the corners and are aligned such that they engage the inner corners of the upper leg 68. The tapering and the angling of the tabs 104 facilitates easy insertion and alignment taking into account irregularities and tolerances of the legs 62 and 68. In addition, should adjustment be required, the spacer assembly 100 can be easily loosened or tightened by turning the screw member 108.

Although the spacer assembly 100 is shown with the spacer member 102 having the tabs angling upward and the spacer spreader element 106 above the spacer member 102, it can be appreciated that the elements may be reversed so that the tabs 104 extend downward with the spreader element 106 below the spacer member 102.

Figure 15:
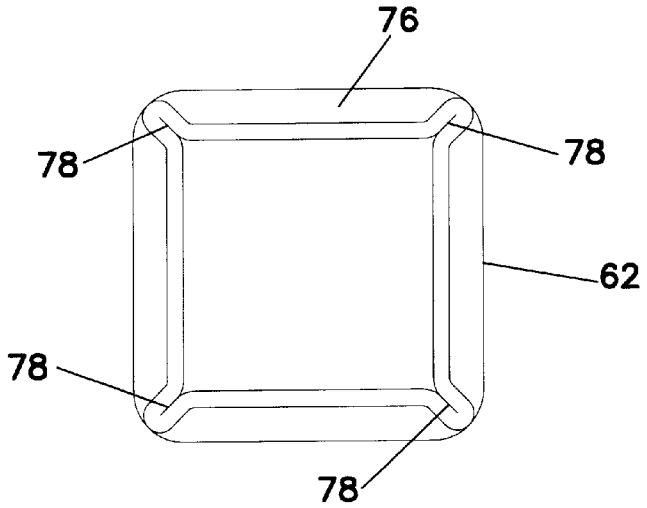
FIG. 15 shows a bottom plan view of a crimped bottom portion of an outer telescoping member for the inner support leg shown in FIG. 7.

In addition to making a tight fit between an upper end of the inner leg member 68 and outer leg member 62, it is also important that a tight fit be made between the lower portion of the outer leg 62 and the outer surface of the inner leg member 68. As shown in FIGS. 9 and 15, the lower portion of the outer leg member 62 is crimped to form an inward angled portion 76. As shown in FIG. 15, this inward crimping creates a substantially rectangular opening through the bottom of the upper leg member 62. The corners form tabs 78 which may be welded to provide additional support and alignment. The inner leg member 68 inserts through the rectangular opening.

Referring to FIGS. 4–6, it can be appreciated that as the inner support legs 32 are unfolded independently of the operation of the linkage 40 or the outer support legs 34, alignment of the inner support legs to provide a stable base for the stage 20 is important. It can also be appreciated that without proper guidance and alignment devices, the inner support legs 32 may become misaligned. Should the inner support legs 32 not be fully unfolded to vertical when the stage 20 is unfolded, the inner portion of the decks 24 may not be properly supported, increasing the risk of the center of the stage 20 collapsing. The inner support legs 32 include a guide bracket 64 which extends inward and includes an arcing lower surface which is utilized in aligning and guiding the inner support legs. Each caster frame 38 includes a pair of edges 96 with a flange 98 extending downward therefrom. It can be appreciated that the flange 98 extends at an angle from a lowermost center portion 97 to a raised upper position at the outer end of the edge 96. It can be appreciated that if the inner support leg 32 is not fully unfolded, the guide bracket 64 engages the edge 96 and the flange 98 including the bottom angled edge 99 shown in FIG. 4, of the flange 98, as shown in FIG. 6, to guide the inner support leg 32 into a vertical position. It can be appreciated that the caster plate 38 provides alignment for the inner support legs 32, when fully unfolded as shown in FIG. 5. The present arrangement of the inner support leg 32 with the guide bracket 64 at a curved lower edge provides for easier sliding between the caster plate 38 and the inner support legs 32. It can also be appreciated that the flange 98 angles along the edge 96, but also includes a lower surface which angles upward. This provides for a two dimensionally aligned guidance surface at the lower edge of the flange 98 providing for alignment not only in a vertical plane but also at an angled, horizontal direction as well. Since an only partially unfolded inner support leg 32 requires vertical and horizontal guidance to fully align the leg to its fully unfolded position, the flange 98 provides improved alignment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding stage, comprising:

a frame:

stage decks mounting to the frame and forming an extended stage surface;

folding inner support legs, and outer support legs associated with each of the stage decks;

a linkage folding the stage along a center axis from a use position wherein the stage decks are substantially horizontal to a folded position wherein the stage decks face one another; and, a caster plate having an angled edge portion and a vertical flange extending downward from the edge portion, the flange having a lower engaging surface associated with each of the stage decks angling upward from a lowermost center section intermediate the lower engaging surfaces, wherein each of the lower engaging surfaces is configured for engaging an inner surface of one of the inner support legs of the associated stage deck during folding.

2. A folding stage according to claim 1, wherein each of the inner support legs includes a guide bracket extending inward from the inner support leg for engaging one of the lower engaging surfaces of the caster plate and aligning the associated support leg.

3. A folding stage, comprising:

a frame:

a pair of stage decks abutting along a centerline mounting to the frame and forming an extended stage surface;

two folding inner support legs, and two outer support legs associated with each of the stage decks;

a guide bracket mounted to each of the inner support legs;

a linkage folding the stage along a center axis from a use position wherein the stage decks are substantially horizontal to a folded position wherein the stage decks face one another; and, a caster plate proximate each side of the stage along the centerline having an angled edge portion and a vertical flange extending downward from the edge portion, the flange having a lower engaging surface associated with one of the inner support legs of each of the stage decks, each of the lower engaging surfaces angling upward from a lowermost center section intermediate the lower engaging surfaces, wherein each of the lower engaging surfaces is configured for engaging an associated one of the guide brackets and aligning its inner support leg.

4. A folding stage according to claim 3, wherein each guide bracket includes an inner lower arcing surface.

5. A telescoping leg device, comprising:

an outer member having a longitudinal direction;

an inner telescoping member inserting into the outer member, and having a mounting portion;

a spacer member having a tab extending obliquely to the longitudinal direction of the outer member;

a spreader member; and, a connector member retaining the spreader member to engage the spacer member tab and attaching to the mounting portion.

6. A telescoping leg device according to claim 5, wherein the connector member retains the spreader member against the spacer member and the spacer member against the inner telescoping member.

7. A telescoping leg device according to claim 6, wherein the spreader member engages the tab and forces the tab against the outer member.

8. A telescoping leg device according to claim 7, wherein the spreader member comprises a rectangular element.

9. A telescoping leg device according to claim 6, wherein the connector member is threaded and wherein the connector member threadably connects to the mounting portion.

10. A telescoping leg device according to claim 5, wherein the outer member and inner telescoping member comprise rectangular elements.

11. A telescoping leg device according to claim 10, wherein a lower portion of the outer rectangular element crimps inward.

12. A telescoping leg device according to claim 5, wherein the spreader member and the spacer member includes orifices formed therein for receiving the connector member.

13. A telescoping leg device according to claim 5, wherein the spreader member comprises a disk.

14. A telescoping leg device according to claim 5, wherein the spacer member has a plurality of tabs.

15. A telescoping leg device according to claim 14, wherein the outer member and inner telescoping member comprise rectangular elements.

16. A telescoping leg device according to claim 15, wherein the tabs extend diagonally engaging inner corners of the outer member.

17. A folding stage, comprising:

a frame:

stage decks mounting to the frame and forming an extended stage surface;

a linkage folding the stage along a center axis from a use position to a folded storage position; and, telescoping legs associated with each of the stage decks, wherein each of the telescoping legs includes:

an outer rectangular member;

an inner rectangular member inserting into the outer rectangular member, and having a mounting portion;

a disk member, having an orifice formed therethrough;

a spacer member having a bore formed therethrough and a plurality of tabs extending axially upward and radially outward; and, a connector member inserting through the orifice and the bore and to the mounting portion.

18. A telescoping leg device, comprising:

an outer member having a longitudinal direction;

an inner telescoping member inserting into the outer member, and having a mounting portion;

a spacer member having opposed tabs extending obliquely to the longitudinal direction of the outer member;

a spreader member; and, a connector member retaining the spreader member to engage the spacer member tabs and attaching to the mounting portion.

19. A telescoping leg device according to claim 18, wherein the spreader member engages the tabs and forces the tabs against the outer member.

20. A telescoping leg device according to claim 19, wherein the outer member and inner telescoping member comprise rectangular elements.

21. A telescoping leg device according to claim 20, wherein the tabs extend diagonally engaging inner corners of the outer member.

* * * * *